US006655501B2

(12) United States Patent
Kostka

(10) Patent No.: US 6,655,501 B2
(45) Date of Patent: Dec. 2, 2003

(54) METHOD FOR SELECTION OF THE MOST FAVORABLE ELEVATOR OF AN ELEVATOR INSTALLATION COMPRISING AT LEAST TWO ELEVATOR GROUPS

(75) Inventor: Miroslav Kostka, Ballwil (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 10/161,227

(22) Filed: Jun. 3, 2002

(65) Prior Publication Data

US 2003/0000776 A1 Jan. 2, 2003

(30) Foreign Application Priority Data

Jun. 29, 2001 (EP) ..... 01810632

(51) Int. Cl.[7] ..... B66B 1/18
(52) U.S. Cl. ..... 187/382; 187/247
(58) Field of Search ..... 1887/380, 382, 1887/383, 385, 387, 388, 389, 384, 247

(56) References Cited

U.S. PATENT DOCUMENTS 3,831,715 A * 8/1974 Matsuzawa et al. ..... 187/383
4,895,223 A * 1/1990 Ekholm et al. ..... 187/383
5,092,430 A * 3/1992 Goto et al. ..... 187/384
5,460,245 A * 10/1995 Bittar ..... 187/383
5,551,533 A * 9/1996 Ng ..... 187/391
5,719,360 A * 2/1998 Davis et al. ..... 187/383
5,969,304 A * 10/1999 Barker et al. ..... 187/383
6,065,570 A * 5/2000 Friedli et al. ..... 187/387
2002/0129994 A1 * 9/2002 Kostka et al. ..... 187/383

FOREIGN PATENT DOCUMENTS

EP 0 301 173 2/1989
EP 0 891 291 10/1997

* cited by examiner

*Primary Examiner*—Jonathan Salata
(74) *Attorney, Agent, or Firm*—MacMillan, Sobanski & Todd, LLC.

(57) ABSTRACT

A method for the selection of the most favorable elevator of a elevator installation having at least two elevator groups, wherein a route with changeovers is available for reaching a destination floor from a start floor, the route being broken down into several stretches. An elevator of one of the elevator groups is allocated to each of the stretches solving the multi-route problem in a destination call multi-group control with journeys involving changeovers.

10 Claims, 5 Drawing Sheets

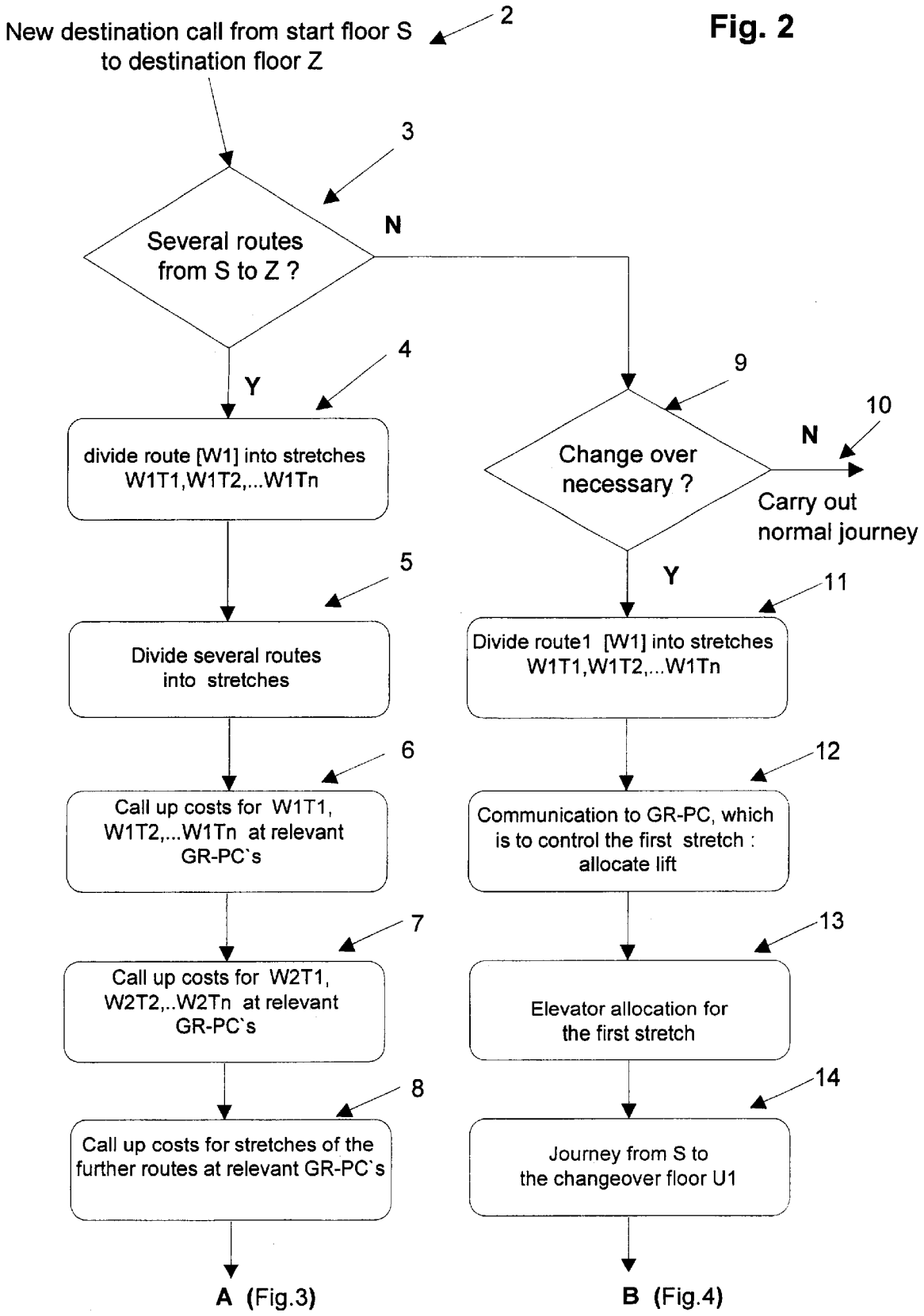
Fig. 2
New destination call from start floor S to destination floor Z
2
3
Several routes from S to Z ?
N
Y
4
divide route [W1] into stretches W1T1,W1T2,...W1Tn
5
Divide several routes into stretches
6
Call up costs for W1T1, W1T2,...W1Tn at relevant GR-PC`s
7
Call up costs for W2T1, W2T2,..W2Tn at relevant GR-PC`s
8
Call up costs for stretches of the further routes at relevant GR-PC`s
A (Fig.3)
9
Change over necessary ?
10
N
Carry out normal journey
Y
11
Divide route1 [W1] into stretches W1T1,W1T2,...W1Tn
12
Communication to GR-PC, which is to control the first stretch : allocate lift
13
Elevator allocation for the first stretch
14
Journey from S to the changeover floor U1
B (Fig.4)

METHOD FOR SELECTION OF THE MOST FAVORABLE ELEVATOR OF AN ELEVATOR INSTALLATION COMPRISING AT LEAST TWO ELEVATOR GROUPS

BACKGROUND OF THE INVENTION

The present invention relates to elevator installations having at least two elevator groups and a method for the selection of the most favorable elevator to serve a hall call.

There is shown in the European patent specification EP 0 891 291 B1 a multi-group control for several elevator groups with destination call control and immediate allocation, in which the destination call input is undertaken inter alia at any call registration device, which is not assigned to a specific elevator group, and the allocated elevator can be made indicated in clear and simple manner. By immediate allocation it is to be understood that the most favorable elevator is immediately allocated to the passenger destination call. The passenger thus does not need to know the division of the building into floor regions that are served only by individual elevator groups. The passenger is informed at an optimal time by visual and acoustic instructions in the elevator car about the next connection leading to the destination floor. There is no precise method indicated exactly how the known multi-group control selects the most favorable elevator when the travel between the start floor and the destination floor is provided with changeovers. At the same time, also no method is indicated how the multi-group control can select the most favorable route when several routes lead to the destination floor.

SUMMARY OF THE INVENTION

The present invention concerns a method for the selection of the most favorable elevator to serve a hall call in elevator installations having at least two elevator groups and which indicates a precise procedure how the most favorable elevator can be selected when the passenger has to make a change in cars between the start floor and the destination floor.

An advantage of the method according to the present invention is that the most optimal elevator cars in terms of costs from the start to the destination are selected. The passenger is thus taken to the destination floor as quickly as possible without loss of time.

In one embodiment of the present invention, the elevator groups each comprise a corresponding group control. This has the advantage that each elevator group can be controlled automatically.

In a preferred embodiment of the present invention, each group control comprises a destination call control with immediate allocation. This has the advantage that in each elevator group the best elevator of the group always can be selected. The early recognition of the destination floor makes it possible to undertake the selection from the elevator cars that can serve the destination floor.

In a further embodiment of the present invention, the group controls of all the elevator groups are connected into a central multi-group control (MGS). This has the advantage that the selection from all elevators in question can take place automatically from a central unit, particularly when the zones served by several elevator groups intersect.

In another embodiment of the present invention, several routes are available for reaching the destination floor from the start floor, wherein the most favorable route is ascertained. This has the advantage that the problem arising with elevator groups, namely several possible routes with changeovers, can be solved. The optimal and quickest route from the start to the destination is thus selected.

All explained features are usable not only in the respectively indicated combination, but also in other combinations or by themselves without departing from the scope of the invention.

Different embodiments of the invention are illustrated in the schematic drawings and explained in more detail in the following description.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIGS. 2 to 5 are flowcharts indicating a method for selection of the most favorable journey in accordance with the method of the present invention.

DESCRIPTION OF THE PREFERRED EMBODIMENT

Figure 1:
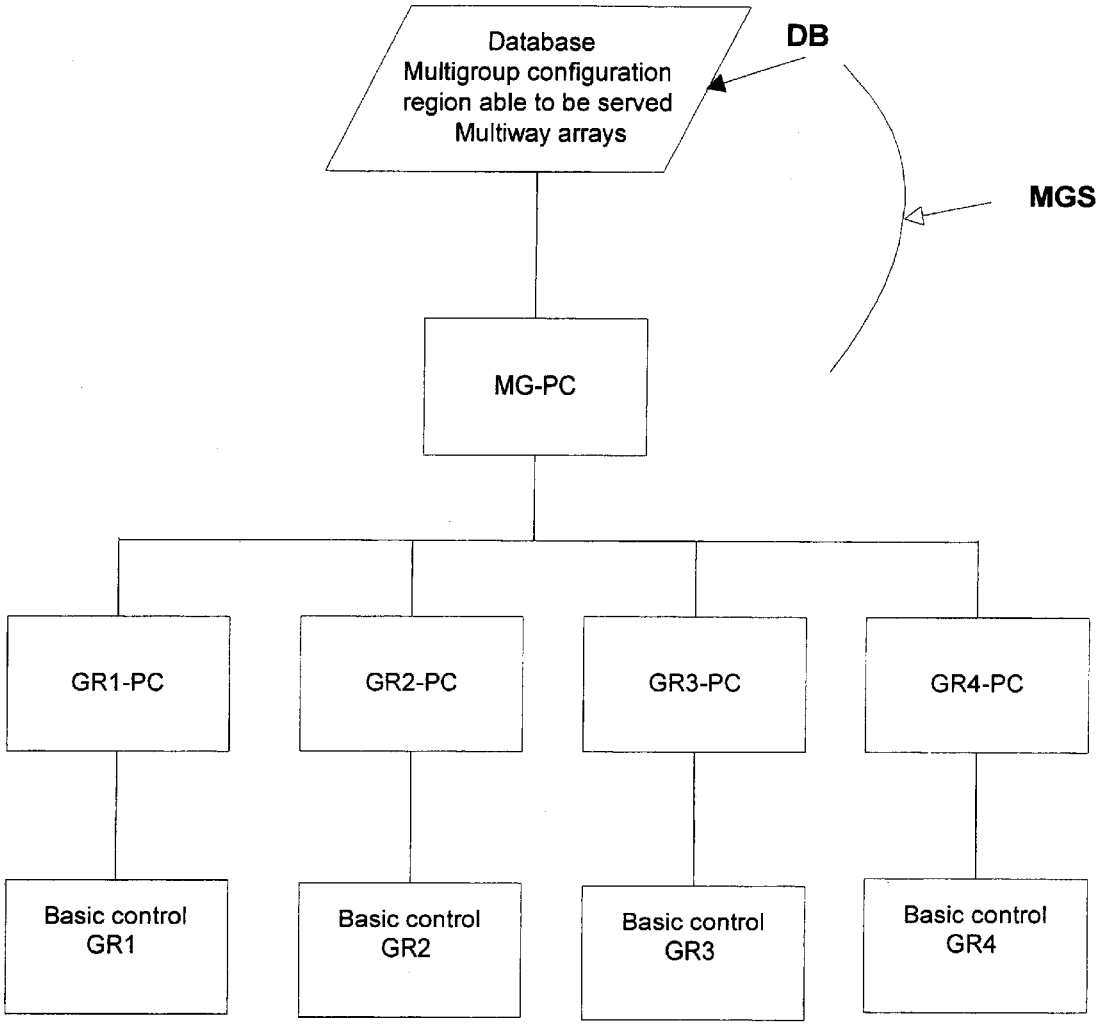
FIG. 1 is a block diagram of four destination call group controls that are connected in common with a multi-group control in accordance with the present invention.

The blocks in FIGS. 1 to 5 are provided with the following legends:

DB—Data bank, multi-group configuration

FW—Favorite route/most favorable route/best line

GR—Elevator group

GR-PC—Group control computer

GR1, 2, 3,4—Group control 1,2,3,4

MG-PC—Multi-group control computer

MGS—Central multi-group control

U1, U2, U3—Changeover floor 1, 2, 3

W1, . . . , Wn—Route

W1T1—Route 1, stretch 1

WnTn—Route n, stretch n

The passenger in the lobby or, however, at any floor inputs the destination floor at one of the multi-group terminals. A central multi-group control MGS (FIG. 1) compares the desired journey with a data bank DB or a journey array in order to establish whether the desired destination floor can be achieved only by one route, also termed line.

In the case of only one possibility of reaching the destination floor by one or several changeovers, the selection of the line is no problem.

If there are several routes—for example, Journey 1: high-rise shuttle with one group and then, after changeover, travel downwards with a elevator of another group, or Journey 2: low-rise shuttle with one group and, after changeover, travel upwards with a elevator of another group—there is initially selected the most likely shortest route, in terms of time, to the destination on the basis of statistical values and the instantaneous travel situation. After selection of the best line, the extended journey is broken down into individual stretches or parts which can usually be served by different elevator groups.

If one of the part travels can be dealt with by any of several elevator groups, a multi-group control functions (as, for example, according to patent EP 0 891 291 B1) in order to determine the first elevator to be used. In the case of only one elevator group, this multi-group control determines the best elevator.

The first elevator to be used is thus evaluated and communicated on the terminal display to the passenger.

During the journey, the central multi-group control MGS tracks the course over time of the elevator travel with respect to arrival at the changeover floor. As soon as the approach time to the changeover floor is fixed (no more intermediate stops possible), the evaluation of the best elevator of the next group for the second journey part begins.

As soon as the next, best elevator is selected, the passenger in the car can be informed. The next elevator to be used to each destination floor, the attainment of which is possible only by elevator car changeovers, is indicated on a car information system or other display. At the same time the audio announcing system is actuated. This instruction can also be combined for several destination floors and/or connecting elevators.

Some advantages of this solution are indicated in the following:

The central multi-group control MGS selects the optimal route from the start floor to the destination floor, divides the selected line up into individual part journeys, i.e. elevator groups, which select the best elevator only for the most optimal moment and, in particular, on the basis of the precisely established remaining travel time in the previously used elevator, the alighting time, the path for walking over between two successively used elevators, the approach time of the elevator, which is soon to be used, for the changeover floor and all other factors which are used in a known multi-group control (such as, for example, according to patent EP 0 891 291 B1) for determining the best elevator.

The passenger is optically and acoustically informed about the next connection at the earliest possible moment.

An immediate allocation takes place, i.e. the passenger is allocated a car immediately after the destination call input.

The passenger does not have to carry a device giving directions.

FIG. 1 shows, as example, four group controls GR1, GR2, GR3 and GR4 which correspondingly have group-control computers GR1-PC, GR2-PC, GR3-PC and GR4-PC. The group controls GR1, GR2, GR3 and GR4 are combined by way of the group control computers GR1-PC, GR2-PC, GR3-PC and GR4-PC in common into the central multi-group control MGS, which comprises the data bank DB and a multi-group control computer MG-PC.

The flowcharts of FIGS. 2 to 5 are described in more detail in the following, wherein the flowcharts in this example are, for the sake of simplicity, shown only up to the third stretch.

The method starts with a step 2 wherein passenger inputs from the starting floor S a new destination call to the destination floor Z.

The central multi-group control MGS compares, in a step 3, the desired journey with the data bank for a journey array DB in order to establish whether the desired destination floor can be reached by way of one route or by way of several routes W1, . . . Wn.

Figure 3:
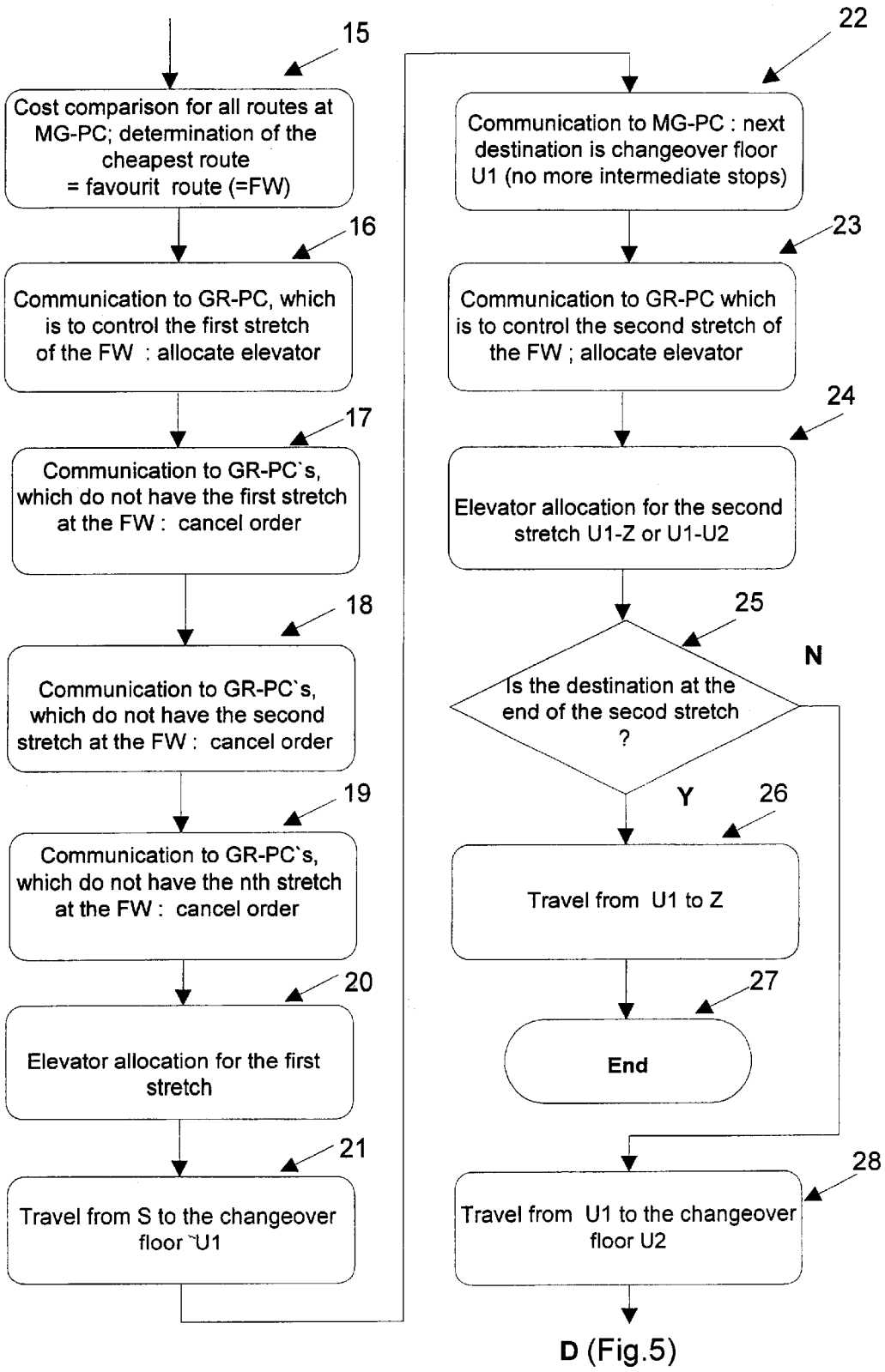
Figure 4:
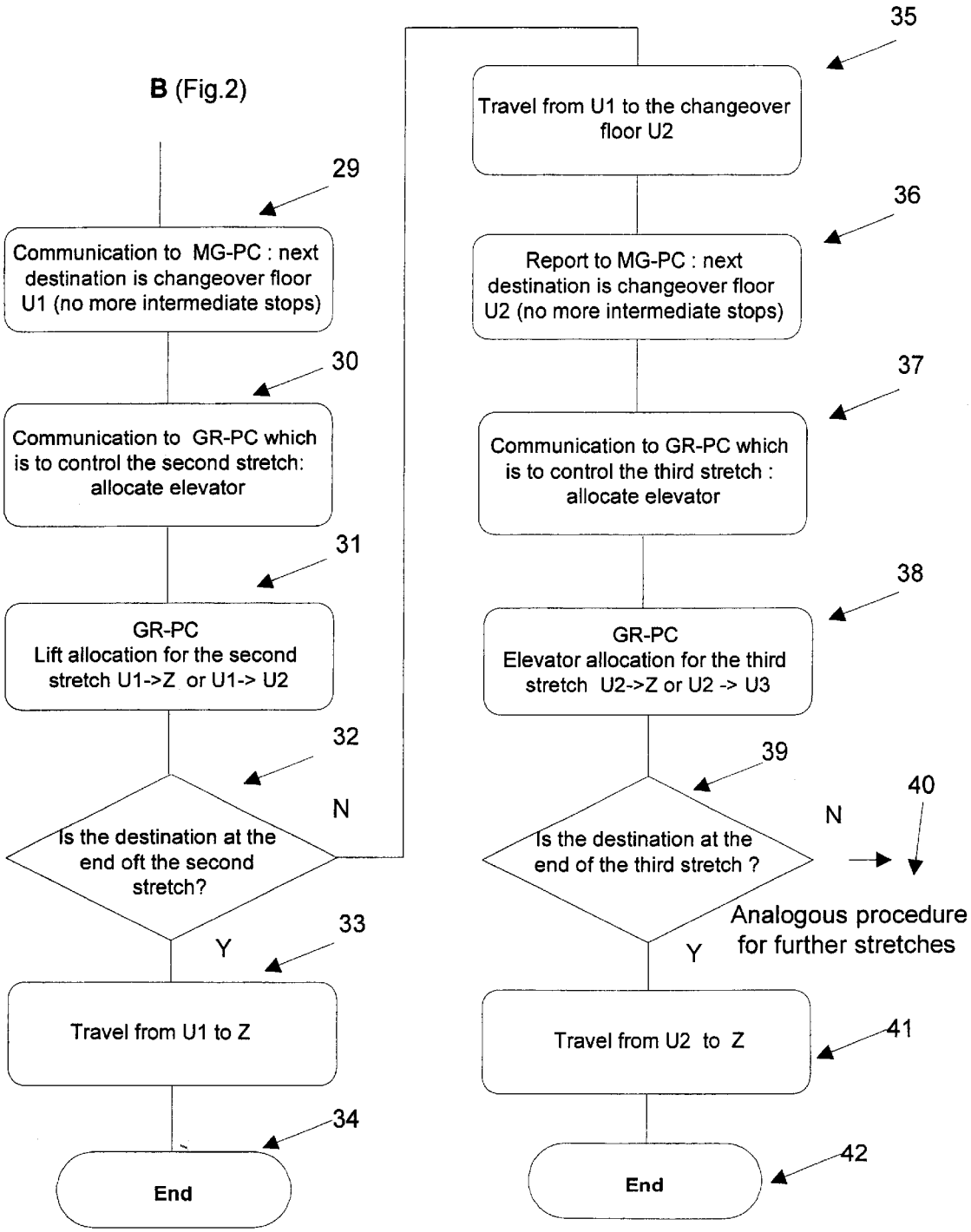
Figure 5:
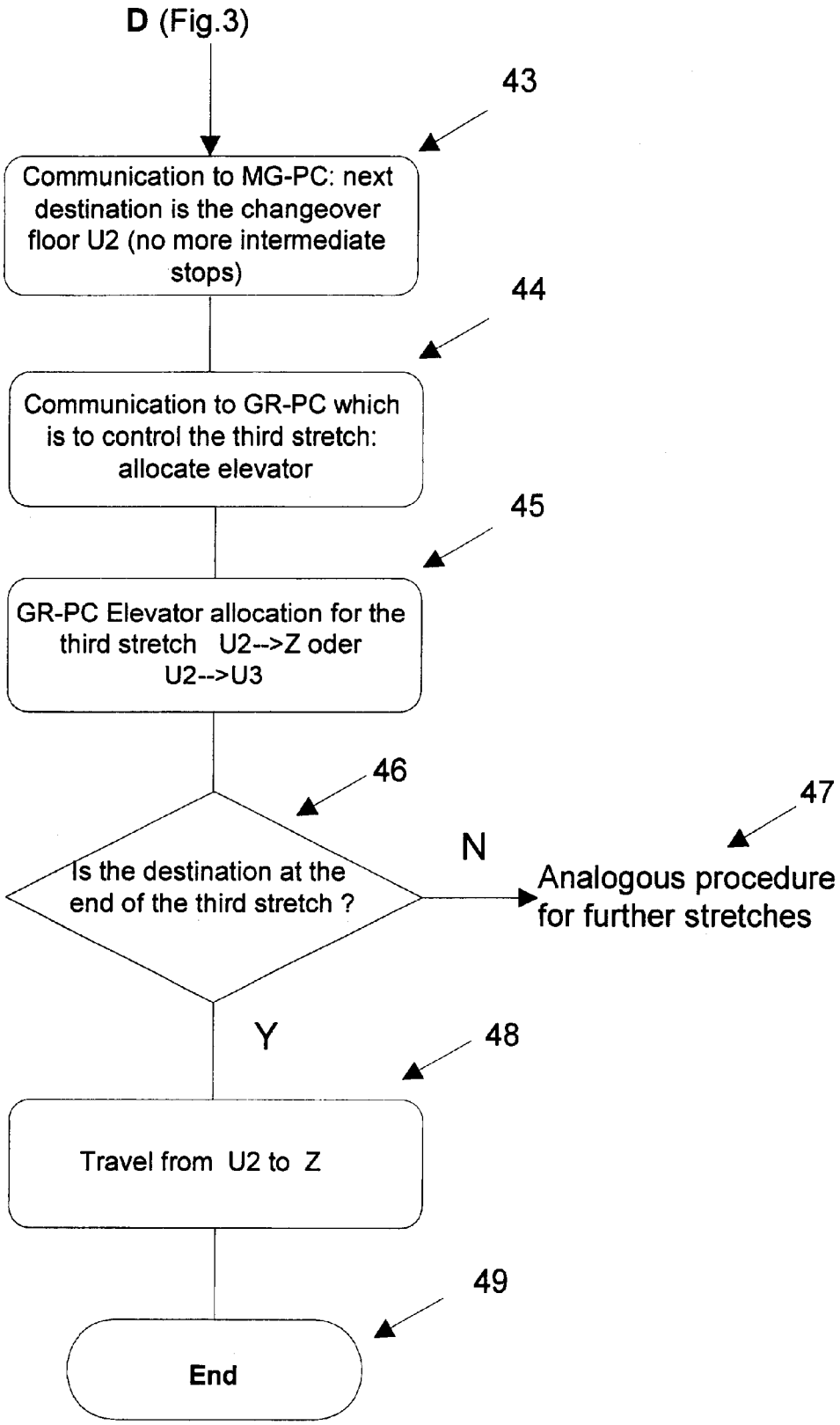

Case A):

If several routes from the start story S to the destination floor Z exist, then the method follows a yes branch "Y" to a step 4 wherein a first route W1 is divided into stretches W1T1, W1T2, . . . , W1Tn, wherein "n" is an integral number. The further routes W2, . . . , Wn are similarly broken down into stretches W2T1, W2T2, . . . , W2Tn or WnT1, WnT2, . . . , WnTn in a step 5. The elevator operating costs of the respective stretches W1T1, W1T2, . . . , W1Tn; W2T1, W2T2, . . . , W2Tn and WnT1, WnT2, . . . , WnTn are then determined in the corresponding relevant group controls GR1, GR2, . . . , GRn in steps 6 through 8. The elevator operating costs of the respective paths W1T1, W1T2, . . . , WTn; W2T1, W2T2, . . . , W2Tn and WnT1, WnT2, . . . , WnTn are now compared in the multi-group control computer MG-PC of the central multi-group control MGS and the favorite route FW is ascertained in a step 15 (FIG. 3). The elevator is allocated in steps 16 and 20 to the group control computer which is to control the first stretch and cancellation of the order is caused in a step 17 at the remaining group control computers which do not have the first stretch of the favorite route FW. Cancellation of the order is caused in a step 18 at the remaining group control computers which do not have the second stretch of the favorite route FW and cancellation of the order is caused for further stretches such as in a step 19 at the remaining group control computers which do not have the final "n" stretch of the favorite route FW. Travel over the first stretch S-U1 from the start floor S to the first changeover floor U1 is then undertaken in a step 21. As soon as it is established that no more intermediate stops are possible, the multi-group control computer MG-PC is informed in a step 22 that the changeover floor U1 is the next destination. In the same manner, the elevator allocation is then made in steps 23 and 24 to the selected elevator group at which the second stretch from the first changeover floor U1 to the destination floor Z (U1-Z) or to the second changeover floor U2 (U1-U2) is carried out. If the destination floor Z lies at the end of the second stretch, a yes branch "Y" from a step 25, then the second stretch U1-Z is traveled in a step 26 and the passenger has reached his destination in a step 27. If the destination floor Z does not lie at the end of the second stretch, a no branch "N" in the step 25, then the second stretch U1-U2 is traveled in a step 28 and the same procedure is used for the further stretches in order to reach the destination floor Z. In this example, the procedure is shown up to the third stretch in steps 43 through 49 of FIG. 5; the same procedure can obviously be used for the further stretches.

Case B):

If only a single route W1 from the start floor S to the destination floor Z exists and a changeover is necessary, yes branch "Y" at the step 9 in FIG. 2, then this route W1 is broken down into stretches W1T1, . . . , W1Tn in a step 11 and in the same manner as above the elevator allocation for the first stretch from the start floor S to the first changeover floor U1 is carried out in steps 12 and 13. As soon as the first stretch has been traveled in a step 14, the same procedure is then used for the remaining stretches as is used in "Case A)" from the changeover floor U1 in steps 29 through 42 of FIG. 4. If a changeover is not necessary a normal journey from the start floor S to the destination floor Z is carried out in a step 10.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for selecting the most favorable route for reaching a destination floor from a start floor in a elevator installation, comprising the steps of:

a. providing a database of a plurality of routes representing the travel of elevator cars in a multi-group elevator installation between floors served by the elevator installation;

b. generating a destination call identifying a start floor and a destination floor;

c. ascertaining from the database each of the plurality of routes from the start floor to the destination floor;

d. dividing each of the ascertained routes into at least two stretches;

e. generating operating costs for each of the stretches for the elevator cars;

f. determining a most favorable one of the ascertained routes based upon the operating costs for the associated stretches; and g. generating an elevator car allocation for each of the stretches of the most favorable one of the ascertained routes.

2. The method according to claim 1 including performing said steps a., c., d., f. and g. with a central multi-group control.

3. The method according to claim 1 including performing said step b. by generating the destination call from one of at least two group controls.

4. The method according to claim 1 including performing said step e. by obtaining the operating costs from at least two group controls.

5. The method according to claim 1 including performing said step f. by comparing the operating costs of the ascertained routes.

6. A method for selecting the most favorable route in a elevator installation having at least two elevator groups for travel from a start floor to a destination floor, comprising the steps of:

a. providing a database of a plurality of routes representing the travel of elevator cars in a multi-group elevator installation between floors served by the elevator installation;

b. generating a destination call identifying a start floor and a destination floor and requiring an elevator changeover;

c. ascertaining from the database each of the plurality of routes from the start floor to the destination floor;

d. dividing each of the ascertained routes into a plurality of stretches, one of said stretches ending at the destination floor and another of said stretches beginning at the destination floor;

e. generating operating costs for each of the stretches for the elevator cars;

f. determining a most favorable one of the ascertained routes based upon the operating costs for the associated stretches; and g. generating an elevator car allocation for each of the stretches of the most favorable one of the ascertained routes.

7. The method according to claim 6 including performing said steps a., c., d., f. and g. with a central multi-group control.

8. The method according to claim 6 including performing said step b. by generating the destination call from one of at least two group controls.

9. The method according to claim 6 including performing said step e. by obtaining the operating costs from at least two group controls.

10. The method according to claim 6 including performing said step f. by comparing the operating costs of the ascertained routes.

* * * * *